US009058785B2

(12) United States Patent
Chen et al.

(10) Patent No.: US 9,058,785 B2
(45) Date of Patent: Jun. 16, 2015

(54) IMAGE DISPLAYING METHOD FOR DISPLAY DEVICE

(71) Applicant: AU OPTRONICS CORP., Hsin-Chu (TW)

(72) Inventors: Jen-Chieh Chen, Hsin-Chu (TW); Chao-Ching Hsu, Hsin-Chu (TW); Tzu-Hui Hsu, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/053,782

(22) Filed: Oct. 15, 2013

(65) Prior Publication Data

US 2014/0055435 A1 Feb. 27, 2014

Related U.S. Application Data

(62) Division of application No. 13/275,419, filed on Oct. 18, 2011, now Pat. No. 8,605,022.

(30) Foreign Application Priority Data

Dec. 30, 2010 (TW) ..... 99147040 A

(51) Int. Cl.
*G09G 3/36* (2006.01)
*G09G 3/20* (2006.01)

(52) U.S. Cl.
CPC ..... *G09G 3/3614* (2013.01); *G09G 3/2044* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,266,039 | B1 | 7/2001 | Aoki | |
| 7,148,871 | B2 | 12/2006 | Sekine | |
| 7,209,103 | B2 | 4/2007 | Maeda et al. | |
| 2003/0156086 | A1 | 8/2003 | Maeda et al. | |
| 2003/0197672 | A1* | 10/2003 | Yun et al. | 345/99 |
| 2004/0104880 | A1 | 6/2004 | Kang et al. | |
| 2004/0196248 | A1 | 10/2004 | Sekine | |
| 2005/0156857 | A1 | 7/2005 | Lee et al. | |
| 2005/0264508 | A1 | 12/2005 | Nakamura et al. | |
| 2006/0007213 | A1* | 1/2006 | Hashimoto et al. | 345/204 |
| 2006/0092120 | A1 | 5/2006 | Nose | |
| 2007/0046610 | A1 | 3/2007 | Okuzono | |
| 2007/0296661 | A1 | 12/2007 | Ishiguchi | |
| 2009/0109158 | A1 | 4/2009 | Shirai | |
| 2009/0185082 | A1* | 7/2009 | Hashimoto | 348/739 |
| 2009/0243974 | A1* | 10/2009 | Tanaka et al. | 345/58 |
| 2010/0118012 | A1 | 5/2010 | Irie et al. | |
| 2010/0123702 | A1 | 5/2010 | Kim | |
| 2010/0231604 | A1 | 9/2010 | Lin et al. | |
| 2012/0113154 | A1 | 5/2012 | Ge et al. | |

FOREIGN PATENT DOCUMENTS

| | | | |
|---|---|---|---|
| CN | 1705006 | A | 12/2005 |
| CN | 1924651 | A | 3/2007 |
| CN | 101188091 | A | 5/2008 |
| TW | 201035948 | A | 10/2010 |

* cited by examiner

*Primary Examiner* — Van Chow
(74) *Attorney, Agent, or Firm* — WPAT, PC; Justin King

(57) ABSTRACT

An exemplary image displaying method for a display device includes steps of: providing display data to pixels of the display device for displaying images; taking a special amount of frame of images as an image group, making polarities of a same pixel being of adjacent two frame of images in the image group and using a same polarity inversion in the adjacent two frame of images be different from each other, and making polarities of a same pixel being of the last frame of image in a former one of adjacent two image groups and of the first frame of image in a latter one of the adjacent two image groups and using the same polarity inversion in the last and first frame of images be the same with each other.

4 Claims, 4 Drawing Sheets

IMAGE DISPLAYING METHOD FOR DISPLAY DEVICE

CROSS-REFERENCE TO RELATED APPLICATION

This is a divisional application of application Ser. No. 13/275419, filed on Oct. 18, 2011, currently pending. The entirety of the above-mentioned patent application is hereby incorporated by reference herein and made a part of this specification.

TECHNICAL FIELD

The disclosure relates to display technologies, and more particularly to an image displaying method for display device.

BACKGROUND

With the development of science and technology, flat panel display devices (e.g., liquid crystal display devices) have many advantages of high display quality, small volume, light weight and wide application range and thus are widely used in consumer electronics products such as mobile phones, laptop computers, desktop computers and televisions, etc. Moreover, the flat panel display devices have evolved into a mainstream display device in place of cathode ray tube (CRT) display devices.

Display units in the flat panel display devices generally are termed as pixels, and in order to achieve better display quality for the flat panel display devices, most of flat panel display devices process display data provided to the pixels in dot inversion manner or 2-line dot inversion manner. So-called dot inversion is that a charged polarity of any one pixel is opposite to the charged polarity of other pixels therearound, and so called 2-line dot inversion is that display data for each two pixels in adjacent two display lines are taken as a unit of polarity inversion. However, although the display data process method of dot inversion or 2-line dot inversion can improve the display quality, the power consumption required for image display would be excessively large.

In the conventional adaptive column inversion technology, the dot inversion (or 2-line dot inversion) and a column inversion are simultaneously used. In particular, when a display data is with a middle gray level (e.g., a gray level is in the gray level range of 4~59 in a 64-level grayscale display), dot inversion or 2-line dot inversion is used to process the display data so as to assure the desired display quality. Contradistinctively, when the display data is with an edge gray level (e.g., a gray level in the gray level range of 0~3 or 60~63 in the 64-level grayscale display), the column inversion is used to process the display data so as to reduce the power consumption.

Although the adaptive column inversion technology has the above advantages, for a flat panel display device using a frame rate control (FRC) technology to simulate higher color resolution, the use of the conventional adaptive column inversion technology for providing display data in such flat panel display device for image display would cause V-line mura and image sticking, so that the evenness of whole displayed image is degraded.

SUMMARY OF EMBODIMENTS

Accordingly, in one aspect of the disclosure, an image displaying method in accordance with an embodiment is adapted to a display device and includes following steps of: providing display data to pixels of the display device for displaying images; taking a specific amount of frame of images as an image group; making polarities of a same pixel being of adjacent two frame of images in a same image group and using a same polarity inversion manner in the adjacent two frame of images be different from each other.

In another aspect of the disclosure, an image displaying method in accordance with an embodiment is adapted to a display device and includes following steps of: providing display data to pixels of the display device for displaying images; taking a specific amount of frame of images as an image group; and making polarities of a same pixel being of the last frame of image in a former one of adjacent two image groups and of the first frame of image in a latter one of the adjacent two image groups and using the same polarity inversion manner in the last and first frame of images be the same with each other.

BRIEF DESCRIPTION OF THE DRAWINGS

The embodiments will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of embodiments of this invention are presented herein for purpose of illustration and description only. It is not intended to be exhaustive or to be limited to the precise form disclosed.

Figure 1:
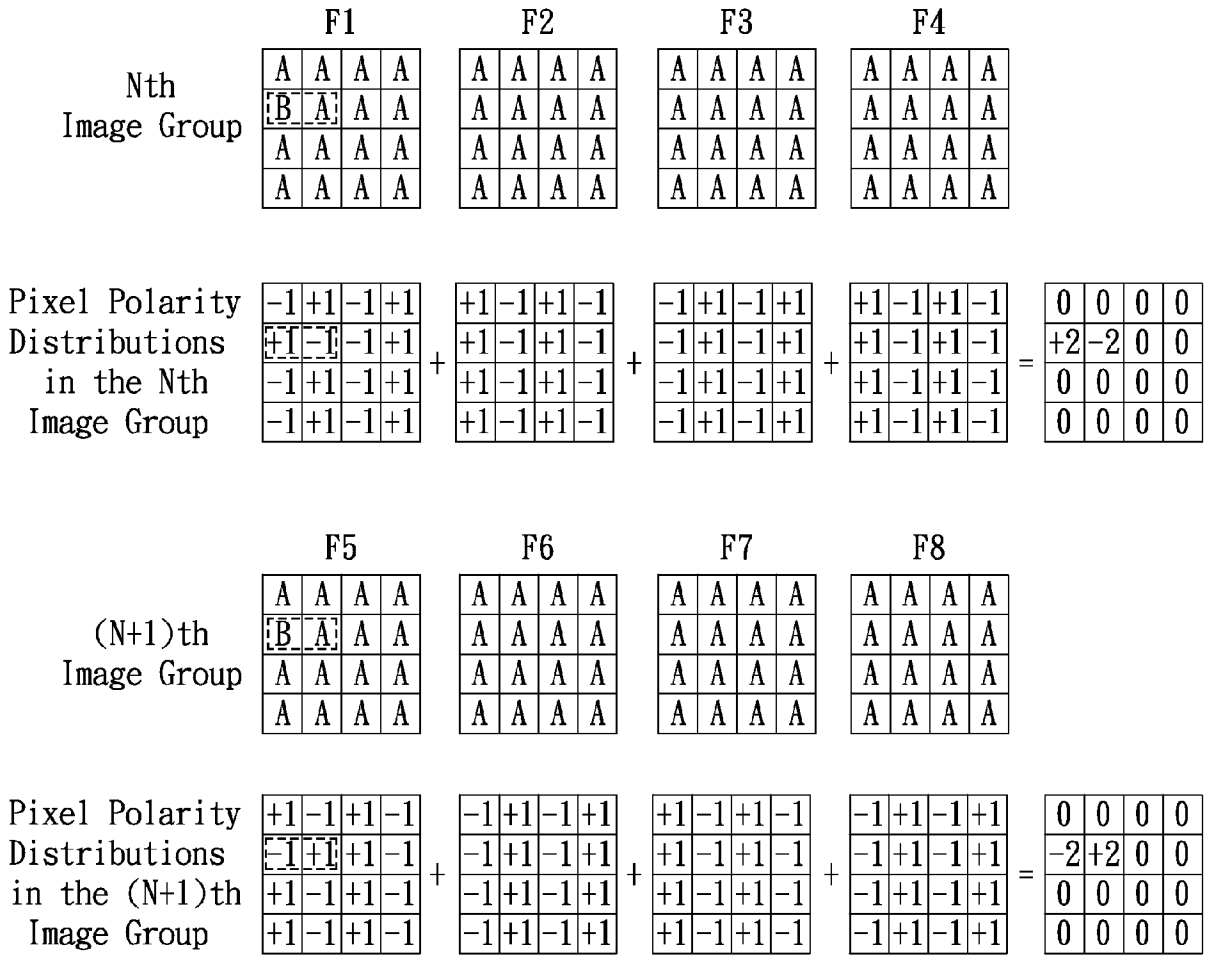
FIG. 1 shows schematic pixel gray level distributions and corresponding pixel polarity distributions in multiple frame of images associated with an image displaying method in accordance with a first embodiment.

Referring to FIG. 1, schematic pixel gray level distributions and corresponding pixel polarity distributions in multiple frame of images associated with an image displaying method in accordance with a first embodiment are shown. In the first embodiment, the image displaying method is adapted to a display device such as a liquid crystal display device, and so on. FIG. 1 illustrates two image groups, e.g., an Nth image group and a (N+1)th image group adjacent thereto. That is, the Nth image group and the (N+1)th image group are successively displayed. In particular, the Nth image group includes multiple successively-displayed frame of images F1, F2, F3, F4, and the (N+1)th image group includes multiple successively-displayed frame of images F5, F6, F7, F8. However, it is noted that, the amount of frame of images in each of the Nth and (N+1)th image groups is not limited to four, and preferably is a multiple of four. The amount of pixels in each frame of images F1~F8 advantageously is an integer times of four, e.g., a 4×4 pixel arrangement as illustrated in FIG. 1, but it is not to limit the disclosure. Each gray level B in the frame of images F1~F8 represents a middle gray level in the range of 4~59 in a 64-level grayscale display, and each gray level A in the frame of images F1~F8 represents an edge gray level in the range of 0~3 or 60~63 in the 64-level grayscale display. In the illustrative embodiment, a pixel with the edge gray level A would use a column inversion manner for polarity setting, while a pixel with the middle gray level B would use a dot inversion manner for polarity setting.

In the following, each the gray level A, representative of the edge gray level of 3 and each the gray level B, representative of the middle gray level of 4 are taken as an example for the convenience of description. Herein, since the gray level B is equal to the gray level A+1, so that each of the frame of images F1~F8 can represent a frame rate control (FRC) pattern.

As depicted in FIG. 1, in the first frame of image F1 in the Nth image group, pixels outside of the dashed rectangle are with the edge gray levels A, so that the column inversion manner is used to set the polarities of such pixels; with regard to the pixel with the middle gray level B inside the dashed rectangle, the dot inversion manner is used to set the polarity of the pixel, and further in order to meet the definition of dot inversion (i.e., the polarity of any one pixel is opposite to the other pixels therearound), the polarity of the pixel with the edge gray level A inside the dashed rectangle is set to be opposite to the polarity of the pixel with the middle gray level B. In the second through fourth frame of images in the Nth image group, the 4×4 pixels all are with the edge gray levels A, and therefore the column inversion manner is used to set the polarities of the 4 ×4 pixels. In short, for the pixels always using the column inversion manner to set their polarities in all the first through fourth frame of images F1~F4, a same pixel in each adjacent two frame of images is set with different polarities, for example, the polarity of the most top left pixel in the frame of images F1~F4 sequentially is "−", "+" "−" and "+". It is indicated that, in the exemplary embodiment, the term [a same pixel] means that the pixel always arranged in a same display position in the frame of images.

In the first frame of image F5 in the (N+1)th image group, the pixels outside of the dashed rectangle are with the edge gray levels A, and therefore the column inversion manner is used to set the polarities of such pixels; in regard to the pixel with the middle gray level B inside the dashed rectangle, the dot inversion manner is used to set its polarity, and further in order to meet the definition of dot inversion, the polarity of the pixel with the edge gray level A inside the dashed rectangle is set to be opposite to the polarity of the pixel with the middle gray level B. In the second through fourth frame of images F6, F7 and F8 in the (N+1)th image group, since the 4×4 pixels all are with the edge gray levels A, and therefore the column inversion manner is used to set the polarities of the 4 ×4 pixels. In short, for the pixels always using the column inversion manner to set their polarities in all the first through fourth frame of images F5~F8, a same pixel in each adjacent two frame of images is set with different polarities, for example, the polarity of the most top left pixel in the frame of images F5~F8 sequentially is "+", "−", "+" and "−", which is inversed to the polarity sequence (i.e., "−", "+", "−" and "+") of the most top left pixel in the frame of images F1~F4 in the Nth image group. In addition, it also can be found from FIG. 1 that: for the pixels using the column inversion manner to set their polarities in both the last frame of image F4 of the Nth image group and the first frame of image F5 of the (N+1)th image group, a same pixel in the last frame of image F4 and the first frame of image F5 is set with a same polarity.

Furthermore, as seen from FIG. 1, during displaying the Nth image group, the two pixels in the dashed rectangle accumulate charges with a certain polarity distribution and thereby cause the unbalance of polarity; and during displaying the (N+1)th image group, the two pixels in the dashed rectangle accumulate charges with another polarity distribution inversed to that during displaying the Nth image group and thereby cause the unbalance of polarity. However, since the pixel polarity sequences are inversed one time in each adjacent two image groups associated with the exemplary embodiment, the charges accumulated by the pixels in the dashed rectangles in each adjacent two image groups are counteracted, achieving the balance of polarity consequently.

Figure 2:
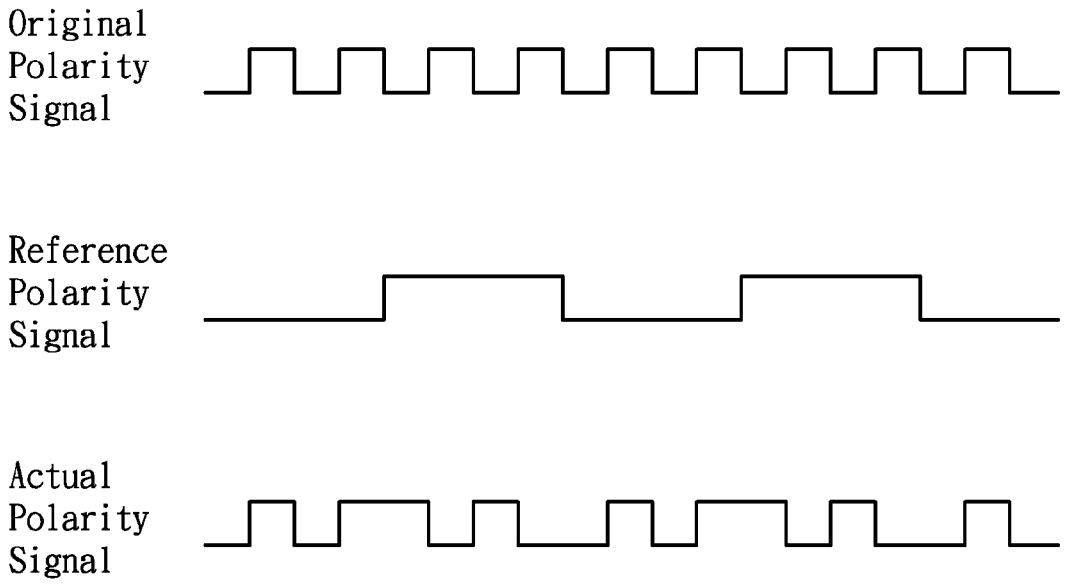
FIG. 2 shows an implementation method of inversing a polarity sequence in each adjacent two image groups.

FIG. 2 illustrates an implementation method of inversing a polarity sequence in each adjacent two image groups. With regard to the pixels always using the column inversion manner to set their polarities in all the frame of images of each adjacent two image groups, a reference polarity signal is additionally generated by a timing controller of the display device to perform a XOR logic operation with an original polarity signal and thereby the timing controller can output an actual polarity signal to achieve a polarity sequence inversion for each adjacent two image groups.

Figure 3:
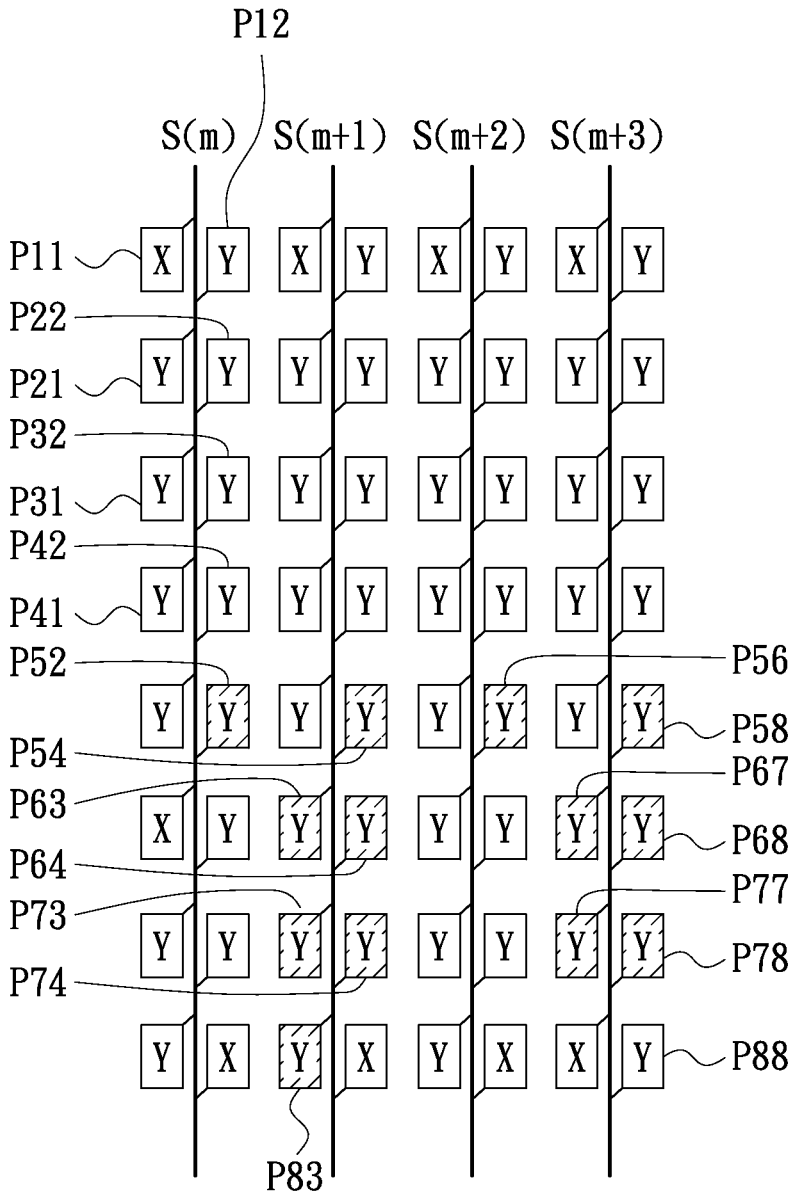
FIG. 3 shows a gray level distribution in a single frame of image associated with an image displaying method in accordance with a second embodiment.

Referring to FIG. 3, a gray level distribution in a single frame of image associated with an image displaying method in accordance with a second embodiment is shown. In the second embodiment, the image displaying method is adapted to a display device e.g., a liquid crystal display device, etc. As depicted in FIG. 3, pixels P11~P88 arranged in an 8×8 matrix are taken as an example for the purpose of illustration, but not to limit the disclosure.

Figure 4A:
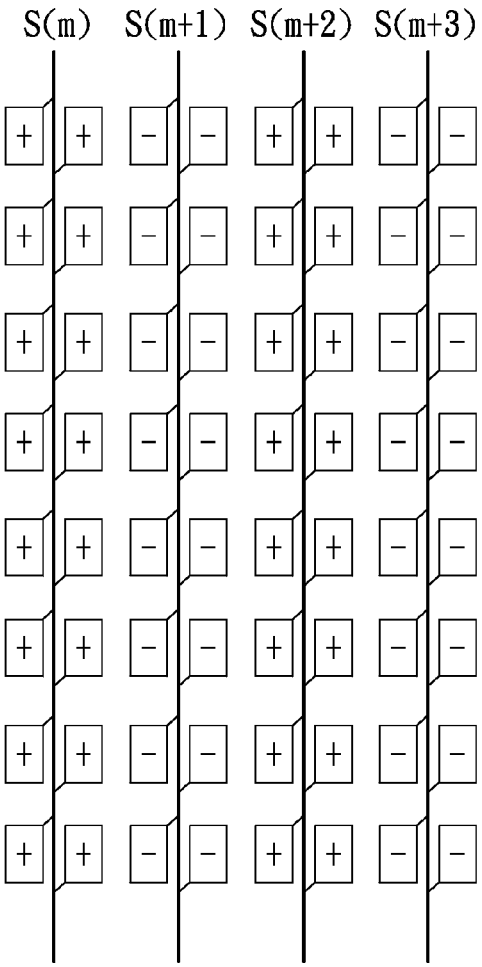
FIGS. 4A and 4B show pixel polarity distributions of 8×8 pixels electrically coupled to multiple data lines using a column inversion manner and a 2-line dot inversion manner respectively.
Figure 4B:
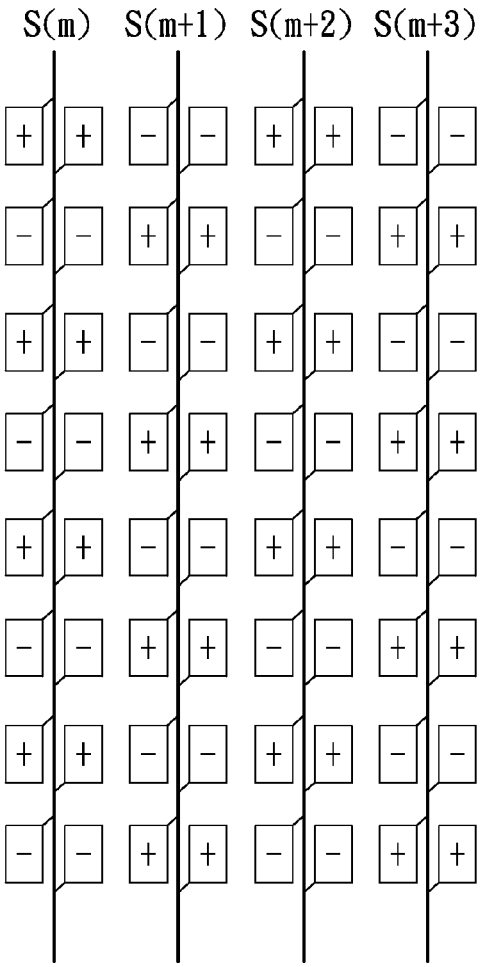

In FIG. 3, four data lines S(m)~S(m+3) are illustrated. Each of the data lines S(m)~S(m+3) has sixteen pixels electrically coupled thereto arranged in two display lines, and each of the data lines S(m)~S(m+3) will provide display data to the sixteen pixels electrically coupled thereto in zigzag manner for image display. In other words, the electrical connection relationship between the pixels P11~P88 and the data lines S(m)~S(m+3) meets the half source driving (HSD) structure. In addition, each gray level X in FIG. 3 represents a middle gray level e.g., in the gray level range of 4~59 in a 64-level grayscale display, and each gray level Y in FIG. 3 represents an edge gray level e.g., in the gray level range of 0~3 or 60~63 in the 64-level grayscale display. In the second embodiment, any pixel with the edge gray level Y would selectively/conditionally use the column inversion manner for polarity setting while any pixel with the middle gray level X would use the 2-line dot inversion manner for polarity setting, so as to avoid the occurrence of pixel charge accumulation to degrade the evenness of whole displayed image. In addition, the column inversion manner can refer to the illustration of FIG. 4A, and the 2-line dot inversion manner can refer to the illustration of FIG. 4B. Herein, FIG. 4A shows a polarity distribution of 8×8 pixels electrically coupled to the data lines S(m)~S(m+3) using the column inversion manner, and FIG. 4B shows another polarity distribution of 8×8 pixels electrically coupled to the data lines S(m)~S(m+3) using the 2-line dot inversion manner.

More specifically, in the second embodiment, when the data line S(m) is taken for example, the pixels being with the middle gray levels X and electrically coupled to the data line S(m) would use the 2-line dot inversion manner for polarity setting, and the pixels being with the edge gray levels Y and electrically coupled to the data line S(m) would selectively use the column inversion manner or the 2-line dot inversion manner for polarity setting. In detail, before providing current display data with an edge gray level Y to a corresponding pixel electrically coupled to the data line S(m), the current display data is judged to be whether immediately following after multiple successively-provided display data with edge gray levels Y to the data line S(m). Herein, the multiple successively-provided display data are, for example eight successively-provided display data with the edge gray level Y constitute a display data group. If the current display data is judged to be immediately following after the eight successively-provided display data, the column inversion manner is selected to set the polarity of the current display data, e.g., the same as the polarity of the pixel P52, whereas, if the current display data is judged to be not immediately following after the eight successively-provided display data, the 2-line dot inversion manner is selected to set the polarity of the current display data, e.g., corresponding to the polarity of the pixel P12, P21, P22, P31, P32, P41, P42 or P51. Similar to the polarity setting for the pixels electrically coupled to the data line S(m), the pixels P54, P63, P64, P73, P74 and P83 electrically coupled to the data line S(m+1), the pixel P56 electrically coupled to the data line S(m+2) and the pixels P58, P67, P68, P77 and P78 electrically coupled to the data line S(m+3) all use the column inversion manner for polarity setting, while the other pixels being with edge gray levels Y and electrically coupled to the respective data lines S(m+1) ~S(m+3) all use the 2-line dot inversion manner for polarity setting.

Sum up, in the various embodiments, particular display data process methods have proposed to set pixel polarities during image display, for example the pixel polarity sequence is inversed one times in each adjacent two image groups, or the pixels charged by display data with edge gray levels would selectively use the first polarity inversion manner (e.g., the column inversion manner) or the second polarity inversion manner (e.g., 2-line dot inversion) for polarity setting. Accordingly, the drawback of degraded evenness of whole displayed image in the prior art can be effectively overcome.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An image displaying method, adapted to a display device comprising:

providing display data to pixels of the display device for displaying images;

taking a specific amount of frames of images as an image group;

displaying a first pixel in a first grey scale;

displaying a plurality of second pixels in a second grey scale;

setting said first pixel to a first polarity value base on a dot inversion manner, setting said plurality of second pixels to either said first polarity value or a second polarity value based on a column inversion manner, and setting any of said plurality of second pixels to said second polarity value by overriding said column inversion manner to support said dot inversion manner of said first pixel; and setting polarities of a same pixel be the same with each other when the same pixel using the same polarity inversion manner in the last frame of image of a former one of immediately adjacent two image groups and the first frame of image of a latter one of the immediately adjacent two image groups.

2. The image displaying method as claimed in claim 1, further comprising:

setting polarities of a same pixel be different from each other when the same pixel using a same polarity inversion manner in adjacent two frame of images of the image group.

3. The image displaying method as claimed in claim 1, wherein the specific amount is a multiple of four.

4. The image displaying method as claimed in claim 1, wherein the same polarity inversion manner is a column inversion manner.

* * * * *